US007486234B2

(12) United States Patent
Watts

(10) Patent No.: US 7,486,234 B2
(45) Date of Patent: Feb. 3, 2009

(54) MICROWAVE CONNECTOR, ANTENNA AND METHOD OF MANUFACTURE OF SAME

(75) Inventor: James Paul Watts, Bodmin (GB)

(73) Assignee: QinetiQ Limited (GB)

( * ) Notice: Subject to any disclaimer, the term of this patent is extended or adjusted under 35 U.S.C. 154(b) by 335 days.

(21) Appl. No.: 10/547,042

(22) PCT Filed: Feb. 27, 2004

(86) PCT No.: PCT/GB2004/000792

§ 371 (c)(1),
(2), (4) Date: Aug. 26, 2005

(87) PCT Pub. No.: WO2004/079863

PCT Pub. Date: Sep. 16, 2004

(65) Prior Publication Data

US 2006/0170593 A1 Aug. 3, 2006

(30) Foreign Application Priority Data

Mar. 6, 2003 (GB) ..... 0305081.2

(51) Int. Cl.
*H01Q 1/38* (2006.01)

(52) U.S. Cl. ..... 343/700 MS; 343/906

(58) Field of Classification Search ..... 343/700 MS, 343/906

See application file for complete search history.

(56) References Cited

U.S. PATENT DOCUMENTS 5,870,058 A * 2/1999 Rothe ..... 343/700 MS
6,198,450 B1 3/2001 Adachi et al.
6,525,631 B1 * 2/2003 Oldfield ..... 333/246
6,556,169 B1 * 4/2003 Fukuura et al. ..... 343/700 MS
6,593,887 B2 * 7/2003 Luk et al. ..... 343/700 MS

FOREIGN PATENT DOCUMENTS

| | | |
|---|---|---|
| EP | 0 283 396 | 9/1988 |
| GB | 1 420 207 | 1/1976 |
| GB | 2 128 416 | 4/1984 |
| GB | 2 219 438 | 12/1989 |
| GB | 2 229 582 | 9/1990 |
| WO | WO 02/33782 | 4/2002 |

OTHER PUBLICATIONS

Hambaba, et al. "Intelligent Hybrid System for Data Mining", Proceedings of the IEEE, pp. 111 (1996).

* cited by examiner

*Primary Examiner*—Trinh V Dinh
*Assistant Examiner*—Dieu Hien T Duong
(74) *Attorney, Agent, or Firm*—McDonnell Boehnen Hulbert & Berghoff LLP

(57) ABSTRACT

A connector adapted to transfer microwave energy between two planes within 45° of perpendicular to one another, comprising a first member comprising a first conductor separated from a first conductive ground plane separated by a first dielectric, the first dielectric having a slot formed therein; and a second member comprising a second conductor separated from a second ground plane by a second dielectric, the second conductor being provided with an electrical connection to the second ground plane at a first end of the second member; in which the first end of the second member extends through the slot in the first member such that the electrical connection is positioned between first ground plane and first conductor. The connector may be a microwave antenna, in which case the first conductor forms a microstrip patch antenna. A method of producing such connectors and an array of such antennas is also disclosed.

22 Claims, 2 Drawing Sheets

MICROWAVE CONNECTOR, ANTENNA AND METHOD OF MANUFACTURE OF SAME

This application is a 371 of PCT/GB04/00792 Feb. 27, 2004.

This invention relates to microwave connectors and antennas typically for use in the microwave spectrum. It also relates to methods of manufacture of same and arrays of such antennas.

Microstrip patch antennas are attractive candidates for the radiating elements of a phased array on account of their low cost, compactness and inherent low mutual coupling. These antennas consist of a rectangular or circular metal patch on a dielectric substrate, backed by a continuous metal ground plane. They are conventionally fed microwave energy by either a probe feed, in which a coaxial connector or cable feeds the patch from behind the ground plane; by a microstrip feedline, in which a microstrip transmission line is connected directly to the patch in the plane of the patch; or through an aperture-coupled feed, in which a microstrip line parallel to the plane of the patch on the opposite side of the ground plane to the patch excites the patch through a slot in the ground plane adjacent to the patch.

However, all of these methods have inherent disadvantages. When microstrip patch antennas are used as the radiating elements in a phased array, a perpendicular feed may be desirable—that is, a feed which extends perpendicularly to the patch. This allows space for active components such as amplifiers or phase shifters to be placed behind the antenna ground plane on a single, perpendicular circuit board. Accordingly, it is preferred not to use the microstrip feedline or aperture-coupled feeds described above. As regards the probe-fed method or other perpendicularly-fed methods that have been suggested, these methods prove impractical for a large array as they require access behind the array face for soldering or tightening electrical connections. Previous perpendicular feeds have also introduced an undesirable asymmetry into the antenna radiation pattern.

The invention provides, according to a first aspect of the invention, a connector adapted to transfer microwave energy between two planes within 45° of perpendicular to one another comprising:

a first member comprising a first conductor separated from a first conductive ground plane by a first dielectric, the first conductive ground plane having a slot formed therein; and a second member comprising a second conductor separated from a second conductive ground plane by a second dielectric, the second conductor being provided with an electrical connection to the second conductive ground plane at a first end of the second member;

in which the first end of the second member extends through the slot in the first conductive ground plane such that the electrical connection is positioned between first conductive ground plane and the first conductor, with the first and second conductors within 45° of perpendicular.

This provides a possibly symmetric connector which allows transfer of microwave energy between two planes which reduces the problem of non-uniformity of radiation whilst being easily manufactured and requiring no soldered joints or similar. In a preferred embodiment the two planes and the first and second conductors are perpendicular to one another.

One or more of the first and second members may be generally planar. In a preferred embodiment both first and second members are generally planar, or at least that portion of the second member that extends through the slot in the first conductive ground plane.

In a preferred embodiment the connector forms an antenna, where the first conductor is a microstrip patch antenna. This advantageously provides a perpendicularly fed antenna with a reduced non-uniformity of radiation and which is easily assembled.

The first member may be provided with a further, third, conductive ground plane spaced from the first ground plane by a third dielectric. This has been shown to improve the performance of the connector. Further conductive ground planes may be provided in a similar fashion.

One or more of the dielectrics may comprise dielectric foam, solid dielectric or an air gap. In a preferred embodiment one or more of the dielectrics comprise a layer of dielectric foam and a layer of solid dielectric. This allows the conductors and conductive ground planes to be directly deposited on the solid dielectric. In an alternative embodiment one or more of the dielectrics may comprise a sheet of solid dielectric separated from the adjacent conductor or conductive ground plane by an air gap. Separation of the conductors and conductive ground plane may be preserved by use of spacers.

A support dielectric may be provided on the opposite side of the first conductor to the first dielectric. The support dielectric may be a solid dielectric. This allows the first conductor to be directly deposited on the support dielectric when it is impracticable to be supported by the first dielectric, for example if the surface of the first dielectric adjacent to the first conductor is a foam dielectric.

The second conductor may comprise a planar element which may be tapered such that it reduces in width as it extends away from the first end of the second dielectric. The taper may be continuous or may be formed of one or more discrete steps.

In a preferred embodiment, the second conductor comprises several steps in order to match the antenna to a microstrip line with 50Ω impedance.

In a preferred embodiment, the electrical connection comprises at least one electrical via which connects the second conductor and second conductive ground planes through the second dielectric. There may be three electrical vias. Alternatively, the second conductor and second conductive plane may extend around the first end of the second dielectric ground sheet to contact one another.

The connector may be adapted to operate in the microwave spectrum, typically between 2 GHz and 18 GHz. In a preferred embodiment it is adapted to operate at around 10 GHz. In a preferred embodiment, the electrical connection may be positioned approximately a quarter of the wavelength in the second dielectric at or about which the connector is to be used from the first, or if present third, conductive ground plane.

According to a second aspect of the invention, there is provided an antenna comprising:

an antenna structure comprising a microstrip patch antenna and a first conductive ground plane separated by a first dielectric;

a feed structure comprising a feed conductor and a second conductive ground plane separated by a second dielectric; the feed conductor and the second conductive ground plane being provided with an electrical connection therebetween at a first end of the feed structure;

in which the feed structure extends through a slot in the first conductive ground plane within 45° to perpendicular to the antenna structure such that the electrical connection lies between the first conductive ground plane and the antenna patch.

This provides a convenient possibly perpendicularly fed antenna which suffers less from non-uniform radiation than prior art antennas, and is easily assembled as it is not necessary to make connection directly behind the antenna face as with the prior art. In a preferred embodiment the feed structure extends perpendicular to the antenna structure.

The antenna is typically suitable for both transmission and reception. When receiving, microwave energy incident on the antenna patch excites an electromagnetic field in the slot in the first conductive ground plane. This induces an electromagnetic field between the feed conductor and the second conductive ground plane and hence transfers the microwave energy to the feed conductor where it can be passed to conventional detection apparatus.

Similarly, for transmission, microwave energy is passed to the feed conductor which causes a varying electromagnetic field to be set up between the feed conductor and the second conductive ground plane. This in turn induces an electromagnetic field in the slot in the first conductive ground plane and excites the patch antenna, which radiates the microwave energy in the usual fashion.

The antenna structure may be provided with a further, third conductive ground plane spaced from the first ground plane by a third dielectric. This has been shown to improve the performance of the antenna. Further conductive ground planes may be provided in a similar manner.

One or more of the dielectrics may comprise dielectric foam, solid dielectric or an air gap. In a preferred embodiment one or more of the dielectrics comprise a layer of dielectric foam and a layer of solid dielectric. This allows the conductors and conductive ground planes to be directly deposited on the solid dielectric. In an alternative embodiment one or more of the dielectrics may comprise a sheet of solid dielectric separated from the adjacent conductor or conductive ground plane by an air gap.

Separation of the conductors and conductive ground planes may be preserved by use of spacers.

A support dielectric may be provided on the opposite side of the antenna patch to the first dielectric. The support dielectric may be a solid dielectric. This allows the antenna patch to be directly deposited on the support dielectric when it is impractical to be supported by the first dielectric, for example if the surface of the first dielectric adjacent to the antenna patch is a foam dielectric.

The feed conductor may be tapered such that it reduces in width as it extends away from the first end of the second dielectric. The taper may be continuous or may be formed of one or more discrete steps.

In a preferred embodiment, the second conductor comprises several steps in order to match the antenna to a microstrip line with 50Ω impedance.

In a preferred embodiment, the electrical connection comprises at least one electrical via which connects the feed conductor and second conductive ground plane through the second dielectric. There may be three electrical vias. Alternatively, the feed conductor and second conductive ground planes may extend around the first end of the second dielectric to contact one another.

The antenna may be adapted to operate in the microwave spectrum, typically between 2 GHz and 18 GHz. In a preferred embodiment it is adapted to operate at around 10 GHz. The electrical connection may be positioned approximately a quarter of the wavelength in the second dielectric at or about which the antenna is to be used from the first, or if present, the third conductive ground plane.

According to a third aspect of the invention, there is provided a method of manufacture of a connector adapted to transfer microwave energy between two planes, comprising:

a) forming a first laminar structure comprising a first conductor and a first conductive ground plane separated by a first layer of dielectric;
b) forming a second laminar structure comprising a second conductor and a second conductive ground plane separated by a second layer of dielectric;
c) passing at least one electrical via through the second laminar structure at a first end thereof to connect second conductor and second conductive ground plane;
d) forming a slot in the first laminar structure through the first conductive ground plane and the first dielectric; and
e) fixing the second laminar structure in the slot such that the electrical via or vias are between the first conductive ground plane and the first conductor.

This method is a great simplification over the prior art in that it is unnecessary to make soldered joints or cable connections in the small space available behind a connector face. Typically, the connector acts as an antenna and the first conductor is an antenna patch.

In a preferred embodiment the step of forming the first or second laminar structure includes the steps of forming one or both sides of a solid dielectric sheet with one or more conductive layers, masking at least one area of one or each conductive layer, etching any unmasked areas to form the first or second conductors or the first or second conductive ground plane and then fixing the solid dielectric to a layer of foam dielectric.

The first laminar structure may include a further, third conductive ground plane separated from the first ground plane by a third layer of dielectric. In such a case, the step of forming a slot in the first laminar member includes forming the slot through the third ground plane and third dielectric layer.

The step of fixing the second laminar structure in the slot may include the step of positioning the electrical via or vias a distance of a quarter of a wavelength, in the second dielectric layer and at which the connector is to be used, from the first or, if present, the third conductive ground plane.

The second laminar structure may be fixed perpendicular to the first laminar structure.

According to a fourth aspect of the invention, there is provided a method of transferring microwave energy from one plane to another, comprising transmitting the energy through a length of parallel plate waveguide having a short-circuit at an end thereof in which the short is positioned in a gap between a conductor in the plane to which the energy is to be transferred and a conductive ground plane parallel to that conductor, or passing the microwave energy through the reverse of the above route.

The parallel-plate waveguide and the conductor may be perpendicular to one another.

In a preferred embodiment, the short-circuit is in a gap between a conductor in the plane to which the energy is to be transferred and two parallel conductive ground planes.

The conductor may be an antenna patch adapted to transmit and receive the microwave energy to be transferred.

According to a fifth aspect of the invention, there is provided an array of antennas according to the first or second aspects of the invention. In a preferred embodiment they form a phased array.

There now follows, by way of example, an embodiment of the invention, described with reference to the accompanying drawings, in which.

Figure 1:
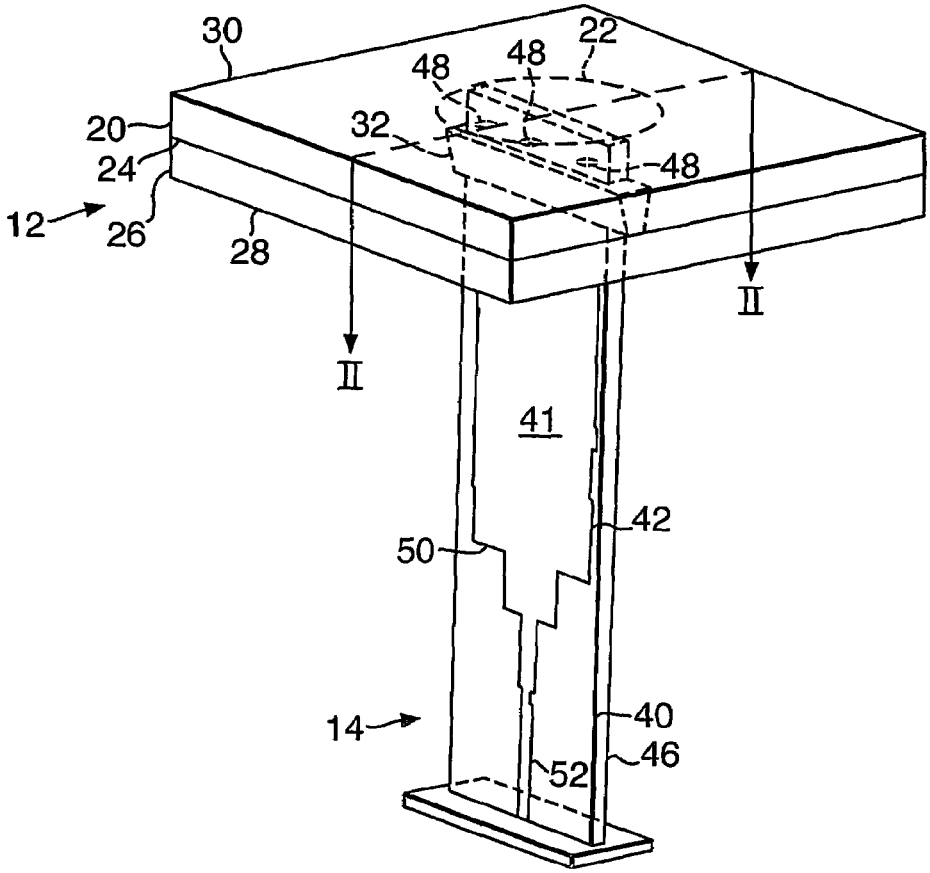
FIG. 1 shows an antenna according to the present invention, showing the internal structure.
Figure 2:
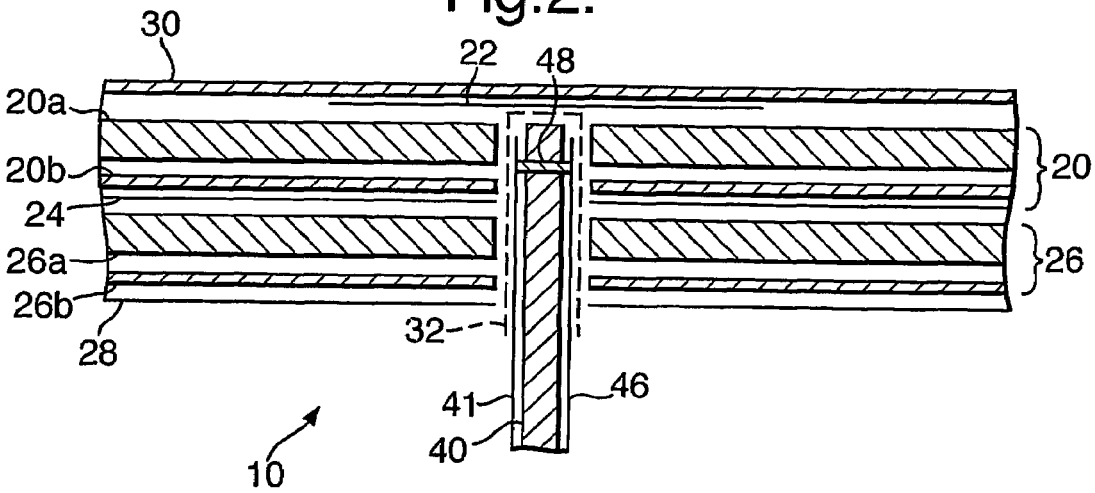
FIG. 2 shows an exploded cross section through line II of FIG. 1.
Figure 3:
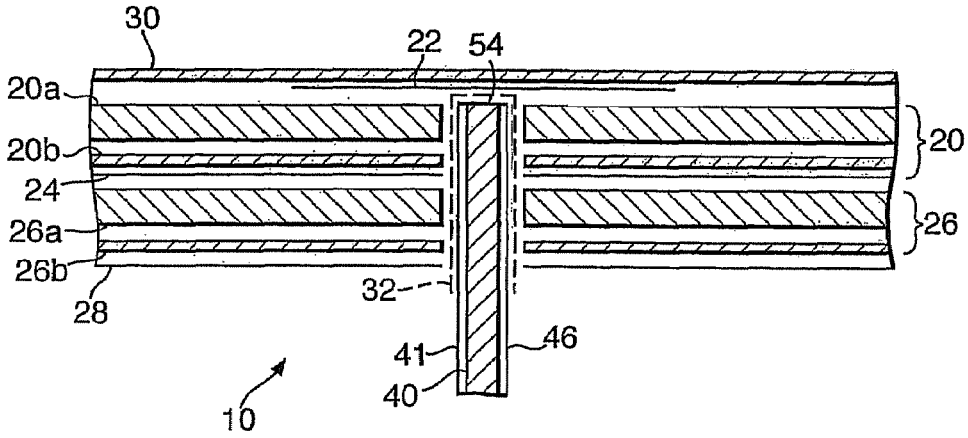

FIG. 3 shows an exploded cross section through line II of FIG. 1 where conductor 41 and conductive ground plane 46 may extend around the first end 54 of dielectric layer 40 to contact one another.

The antenna 10 shown in the accompanying drawings comprises two members, a first member or antenna structure 12 and a second member or feed structure 14. Each of the structures comprise a number of layers as described below.

The antenna structure 12 comprises two dielectric layers 20, 26 each with a conductive ground plane 24, 28 on its underside. The first dielectric layer 20 is mounted on top of the second dielectric layer 26. Each of the dielectric layers comprise an upper layer of dielectric foam 20*a*, 26*a* with a layer of solid dielectric 20*b*, 26*b* attached to the underside. On top of the first dielectric layer is mounted an antenna support dielectric 30. This comprises a thin layer of solid dielectric on the underside of which has been formed a circular antenna patch 22.

The feed structure 14 comprises a single layer of solid dielectric 40. On the rear side of this a conductive ground plane 46 is provided. On the front of the dielectric layer 40 a conductor 41 is provided which is shaped so as to define together with the ground plane an area of parallel-plate waveguide 42 at a first end of the dielectric layer and a microstrip feed 52 at a second end of the dielectric layer. The conductor 41 also defines the transition 50 between the two areas 42, 52 by varying width from nearly a half of the wavelength at which the antenna is to be used in the parallel plate waveguide region 42 to typical microstrip dimensions (of the order of a few millimeters) in the microstrip feed region 52. The transition 50 comprises a number of discrete changes in width of conductor.

The conductive ground plane 46 and conductor 41 of the feed structure 14 are electrically connected at the first end of the dielectric layer by means of a number, in this case three, of conductive vias 48 which pass through the dielectric layer 40 to connect the two conductors 41, 46.

The antenna structure is further provided with a slot 32 extending perpendicularly from but not through the antenna patch 22 through first and second dielectric layers 20, 26 and ground planes 24, 28.

The first end of the feed structure 14 is fixed inside the slot 32 such that the feed structure 14 lies perpendicular to the antenna structure 12. The slot is sized so as to fit the feed structure 14 in this position. The feed structure is placed so that the distance from the conductive vias 48 to the second, outer ground plane 28 of the antenna structure 12 is approximately a quarter of the wavelength at which the antenna is intended to be used.

In use as a transmit antenna 10, the signal to be transmitted is fed to the microstrip region 52 of conductor 41. All ground planes are held at an earth potential. Conductive vias 48 therefore provide a short circuit between feed and ground. As the feed structure 14 is symmetric in the parallel-plate waveguide region 40 about a plane parallel to and centred between conductor 41 and feed ground plane 46, a symmetric electro-magnetic field is generated in the region of the slot 32. This induces electromagnetic fields in the slot 32, which in turn excites the antenna patch 22 which then transmits in the usual manner.

Reception by the antenna 10 occurs in a similar fashion. Radiation incident on antenna patch 22 excites an EM field in the slot 32. This induces an EM field between the feed conductor 41 and the feed ground plane 46 in the parallel plate waveguide region 42. This passes through transition 50 to microstrip region 52 where it can be detected by standard equipment.

The materials and techniques used in the manufacture of the antenna 10 are all well known in the art. The solid dielectrics 30, 20*b*, 26*b* are typically random microfibre glass in a PTFE matrix material having a dielectric constant of 2.2. The solid dielectric 40 is typically a ceramic in PTFE matrix material having a dielectric constant of 10.2. The foam dielectrics are typically a rigid foam plastic based on polymethacrylimide and have a dielectric constant of 1.05 at 10 GHz. Typical foam thickness for use at 10 GHz are 1.5 mm. Use of the combination of foam and solid dielectrics allows flat plates of conductive material, typically copper, to be plated onto the solid dielectric. This can then be etched to define the conductive areas to be the desired shapes.

To form the antenna described herein laminar structures corresponding to the antenna structure 12 and feed structure 14 are formed. This comprises coating three solid dielectric sheets with a layer of metal, typically copper on one side thereof and a fourth dielectric sheet with similar layers of metal on both sides. Areas of these sheets are masked then etched to define the antenna patch 22 on antenna support dielectric 30, first 24 and second 28 ground planes on solid dielectrics 20*b* and 26*b* and conductor 41 and ground plane 46 of feed structure 14. The masks define the shapes of the conductive areas as described above.

The antenna support dielectric 30 and solid dielectrics 20*b* and 26*b* are then positioned with foam dielectric layers 20*a* and 26*b* between antenna support dielectric 30 and first solid dielectric 20*b* and between first solid dielectric layer 20*b* and second solid dielectric layer 26*b*. This complete antenna structure 12 is then fixed together using adhesive. The slot 32 is milled out so as to pass through first and second ground planes 24, 28 and first and second dielectric layers 20 and 26.

The electrical vias 48 are drilled through the first end of feed structure 14 and plated to electrically connect conductor 41 and conductive ground plane 46. The feed structure 14 is then fixed in the slot 32 such that electrical vias are approximately a quarter of the wavelength at which the antenna (in the feed structure 14 dielectric 40) is to be used from the second ground plane 28.

The invention claimed is:

1. A connector adapted to transfer microwave energy between two planes having an angle there-between within a range 45° to 90°, comprising:

a first member comprising a first conductor separated from a first conductive ground plane by a first dielectric, the first conductive ground plane and the first dielectric having a slot formed therein; and a second member comprising a second conductor separated from a second conductive ground plane by a second dielectric, the second conductor being provided with an electrical connection to the second conductive ground plane at a first end of the second member;

in which the first end of the second member extends through the slot in the first conductive ground plane such that the electrical connection is positioned between the first conductive ground plane and the first conductor with the first and second conductors having an angle there-between within the range 45° to 90°; wherein the electrical connection is selected from the group of electrical connections consisting of at least one conductive via which connects the second conductor and the second conductive ground plane through the second dielectric and the second conductor and the second conductive ground plane that extend around an end of the second dielectric to contact one another.

2. The connector of claim 1 in which one or more of the first and second members is generally planar.

3. The connector of claim 2 in which the first and second conductors are perpendicular to one another.

4. The connector of claim 1 in which the electrical connection is positioned approximately a quarter of the wavelength in the second dielectric at or about which the connector is to be used from the first conductive ground plane.

5. The connector of claim 1 in which the first member is provided with a further, third, conductive ground plane spaced from the first ground plane by a third dielectric.

6. The connector of claim 1 in which one or more of the dielectrics comprises dielectric foam, solid dielectric or an air gap.

7. The connector of claim 6 in which one or more of the dielectrics comprise a layer of dielectric foam and a layer of solid dielectric.

8. The connector of claim 6 in which one or more of the dielectrics comprise a sheet of solid dielectric separated from an adjacent conductor or an adjacent conductive ground plane by an air gap.

9. The connector of claim 1 in which a support dielectric is provided on the opposite side of the first conductor to the first dielectric.

10. The connector of claim 1 in which the second conductor comprises a planar element which is tapered such that it reduces in width as it extends away from the first end of the second dielectric.

11. An antenna comprising:

an antenna structure comprising an antenna patch and a first conductive ground plane separated by a first dielectric;

a feed structure comprising a feed conductor and a second conductive ground plane separated by a second dielectric; the feed conductor and the second conductive ground plane being provided with an electrical connection therebetween at a first end of the feed structure;

in which the feed structure extends through a slot in the first conductive ground plane and the first dielectric at an angle within a range 45° to 90° to the antenna structure such that the electrical connection lies between the first conductive ground plane and the antenna patch; wherein the electrical connection is selected from the group of electrical connections consisting of at least one conductive via which connects the second conductor and the second conductive ground plane through the second dielectric and the second conductor and the second conductive ground plane that extend around an end of the second dielectric to contact one another.

12. The antenna patch of claim 11 in which the feed structure and the antenna structure are perpendicular to one another.

13. The antenna of claim 11 in which the electrical connection is positioned approximately a quarter of the wavelength in the second dielectric at or about which the antenna is to be used from the first conductive ground plane.

14. The antenna of claim 11 in which the antenna structure is provided with a further, third conductive ground plane spaced from the first ground plane by a third dielectric.

15. The antenna of claim 11 in which the feed conductor is tapered such that it reduces in width as it extends away from the first end of the second dielectric.

16. The antenna of claim 11 in which the antenna is adapted to operate in the microwave spectrum, between 2 GHz and 18 GHz.

17. A method of manufacture of a connector adapted to transfer microwave energy between two planes, comprising:

a) forming a first laminar structure comprising a first conductor and a first conductive ground plane separated by a first layer of dielectric;

b) forming a second laminar structure comprising a second conductor and a second conductive ground plane separated by a second layer of dielectric;

c) passing at least one electrical conductive via through the second laminar structure at a first end thereof to connect second conductor and second conductive ground plane;

d) forming a slot in the first laminar structure through the first conductive ground plane and the first dielectric; and e) fixing the second laminar structure in the slot such that the electrical conductive via or vias are between the first conductive ground plane and the first conductor.

18. The method of claim 17 in which the connector acts as an antenna and the first conductor is a microstrip antenna.

19. The method of claim 17 in which the step of forming the first or second laminar structure includes the steps of forming one or both sides of a solid dielectric sheet with one or more conductive layers, masking at least one area of one or each conductive layer, etching any unmasked areas to form the first or second conductors or the first or second conductive ground planes and then fixing the solid dielectric to a layer of foam dielectric.

20. The method of claim 17 in which the step of fixing the second laminar structure in the slot includes the step of positioning the electrical via or vias a distance of a quarter of a wavelength, in the second dielectric layer and at which the connector is to be used, from the first conductive ground plane.

21. The method of claim 17 in which the first laminar structure includes a further, third conductive ground plane separated from the first ground plane by a third layer of dielectric and the step of forming a slot in the first laminar member includes forming the slot through the third ground plane and third dielectric layer.

22. The method of claim 17 in which the second laminar structure is fixed perpendicular to the first laminar structure.

* * * * *